US007837495B2

(12) United States Patent
Baldwin et al.

(10) Patent No.: US 7,837,495 B2
(45) **Date of Patent: *Nov. 23, 2010**

(54) STRAIN RELIEF BACKSHELL ASSEMBLY

(75) Inventors: Brendon A. Baldwin, Guilfiord, NY (US); David Otis Gallusser, Oneonta, NY (US); Benardino F Porcaro, Poughquag, NY (US)

(73) Assignee: Amphenol Corporation, Wallingford, CT (US)

( * ) Notice: Subject to any disclaimer, the term of this patent is extended or adjusted under 35 U.S.C. 154(b) by 39 days.

This patent is subject to a terminal disclaimer.

(21) Appl. No.: 12/250,724

(22) Filed: Oct. 14, 2008

(65) Prior Publication Data

US 2009/0111319 A1 Apr. 30, 2009

Related U.S. Application Data

(63) Continuation-in-part of application No. 11/976,359, filed on Oct. 24, 2007, now Pat. No. 7,544,085.

(51) Int. Cl.
*H01R 13/58* (2006.01)

(52) U.S. Cl. ..... 439/459; 439/446; 439/607.41; 439/607.5

(58) Field of Classification Search ..... 439/459, 439/471, 446, 472, 607.41, 607.5
See application file for complete search history.

(56) References Cited

U.S. PATENT DOCUMENTS

| | | | | |
|---|---|---|---|---|
| 3,603,913 | A | 9/1971 | Hasty, Jr. | |
| 3,732,527 | A | 5/1973 | McKnight | |
| 3,781,762 | A | 12/1973 | Quackenbush | |
| 4,135,776 | A | 1/1979 | Ailawadhi et al. | |
| 4,564,255 | A | 1/1986 | Kirma | |
| 4,761,146 | A | 8/1988 | Sohoel | |
| 4,901,608 | A | 2/1990 | Shieh et al. | |
| 6,220,889 | B1 | 4/2001 | Ely et al. | |
| 6,419,519 | B1 | 7/2002 | Young | |
| 7,544,085 | B2 * | 6/2009 | Baldwin et al. | 439/471 |

FOREIGN PATENT DOCUMENTS

| | | |
|---|---|---|
| DE | 3135781 | 3/1983 |
| JP | 2001-304488 | 10/2001 |
| JP | 2007-188838 | 7/2007 |

* cited by examiner

*Primary Examiner*—Tho D Ta
*Assistant Examiner*—Travis Chambers
(74) *Attorney, Agent, or Firm*—Blank Rome LLP

(57) ABSTRACT

A backshell assembly that includes a housing configured to terminate a cable. The housing has a main body defining a central longitudinal axis, a connector interface for mating with an electrical connector, and at least one adjustment extension extending from the main body opposite the connector interface and substantially parallel to the central longitudinal axis. An adjustable strain relief structure is coupleable to the cable and the housing. The adjustable strain relief structure including at least one adjustment member cooperating with the adjustment extension of the housing such that the adjustment member is pivotable between different cable positions with respect to the central longitudinal axis of the housing. A movable locking member is coupleable with the adjustment extension of the housing and the adjustment member of the adjustable strain relief structure to releasably lock the adjustment member in a selected cable position with respect to the housing. A biasing member is supported by the locking member. The biasing member biasing the locking member into engagement with the adjustment extension of the housing and the adjustment member. The biasing member allows adjustment of the adjustment member between the different cable positions with respect to the adjustment extension of the housing without disassembly of the housing and the adjustable strain relief structure.

20 Claims, 13 Drawing Sheets

STRAIN RELIEF BACKSHELL ASSEMBLY

FIELD OF THE INVENTION

The present invention relates to a strain relief backshell assembly that terminates a cable for mating with an electrical connector. The strain relief backshell assembly is adjustable to different configurations of the cable with respect to the electrical connector.

BACKGROUND OF THE INVENTION

Backshell assemblies provide a transition between a cable and an electrical connector. Strain relief backshell assemblies in particular provide a clamping force on the wire bundle of the cable to prevent damage to the termination of the wires at the electrical connector. Various configurations of the backshell assemblies are known. For example, 0°, 45° and 90° configurations of backshell assemblies are known in which the configurations are defined by the angle between the cable and the backshell assembly. Conventional backshells are typically available in both EMI and Non-EMI versions. EMI backshells provide termination of cable shielding braid through a series of components to complete a conductive path from individual wire shielding to the electrical connector. The conductive interface between the backshell assembly and the electrical connector is typically the accessory locating teeth.

The various configurations of conventional backshell assemblies are often separately manufactured. That requires separate tooling for each configuration, thereby increasing costs of the assemblies. Also, unless a user can accurately predict the number and types of configurations of the backshell assemblies needed, any field changes would require the user to purchase additional backshell assemblies.

SUMMARY OF THE INVENTION

Accordingly, the present invention relates to a backshell assembly that includes a housing configured to terminate a cable. The housing has a main body defining a central longitudinal axis, a connector interface for mating with an electrical connector, and at least one adjustment extension extending from the main body opposite the connector interface and substantially parallel to the central longitudinal axis. An adjustable strain relief structure is coupleable to the cable and the housing. The adjustable strain relief structure including at least one adjustment member cooperating with the adjustment extension of the housing such that the adjustment member is pivotable between different cable positions with respect to the central longitudinal axis of the housing. A movable locking member is coupleable with the adjustment extension of the housing and the adjustment member of the adjustable strain relief structure to releasably lock the adjustment member in a selected cable position with respect to the housing. A biasing member is supported by the locking member. The biasing member biasing the locking member into engagement with the adjustment extension of the housing and the adjustment member. The biasing member allows adjustment of the adjustment member between the different cable positions with respect to the adjustment extension of the housing without disassembly of the housing and the adjustable strain relief structure.

The present invention also relates to a backshell assembly that includes a housing configured to terminate a cable. The housing has a main body defining a central longitudinal axis, and a connector interface for mating with an electrical connector. An adjustment member coupleable to the cable and the housing such that the adjustment member is pivotable between different cable positions with respect to the central longitudinal axis of the housing. The adjustment member includes an opening having gear teeth. A movable locking member is coupleable with the housing and the adjustment member to releasably lock the adjustment member in a selected cable position with respect to the housing. The movable locking member includes gear teeth corresponding to the gear teeth of the adjustment member. A biasing member is supported by the locking member. The biasing member biases the locking member into engagement with the housing and the adjustment member when the gear teeth of the adjustment member and the gear teeth of the locking member engage. The biasing member allows adjustment of the adjustment member between the different cable positions with respect to the housing without disassembly of the housing and the adjustment member.

The present invention also relates to a method of adjusting a backshell assembly for a cable including the steps of terminating an end of the cable with the housing of the backshell assembly; coupling the adjustable strain relief structure to the cable; coupling the adjustable strain relief structure with the housing by releasably engaging the locking member with an adjustment of the adjustable strain relief structure and with an extension of the housing to configure the cable in at least a first position with respect to the housing allowing rotation of the adjustable strain relief structure and the cable with respect to the housing; disengaging the locking member from the housing and the adjustable strain relief structure by slidably moving the locking member with respect to the housing and the adjustment member against the bias of a biasing member supported by the locking member; and releasably locking the adjustment member of the adjustable strain relief structure in a second position different from the first position by sliding the locking member into engagement with the housing and the adjustment member with the bias of the biasing member.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Referring to FIGS. 1-6, the present invention relates to a strain relief backshell assembly 100 for coupling an electrical connector 600 (FIG. 6) with EMI braid shield S covering a cable C. The backshell assembly 100 allows adjustment of the position of the cable C with respect to the connector without having to disassemble the components of the backshell assembly 100. The backshell assembly 100 is also configured to provide improved EMI protection.

Figure 3A:
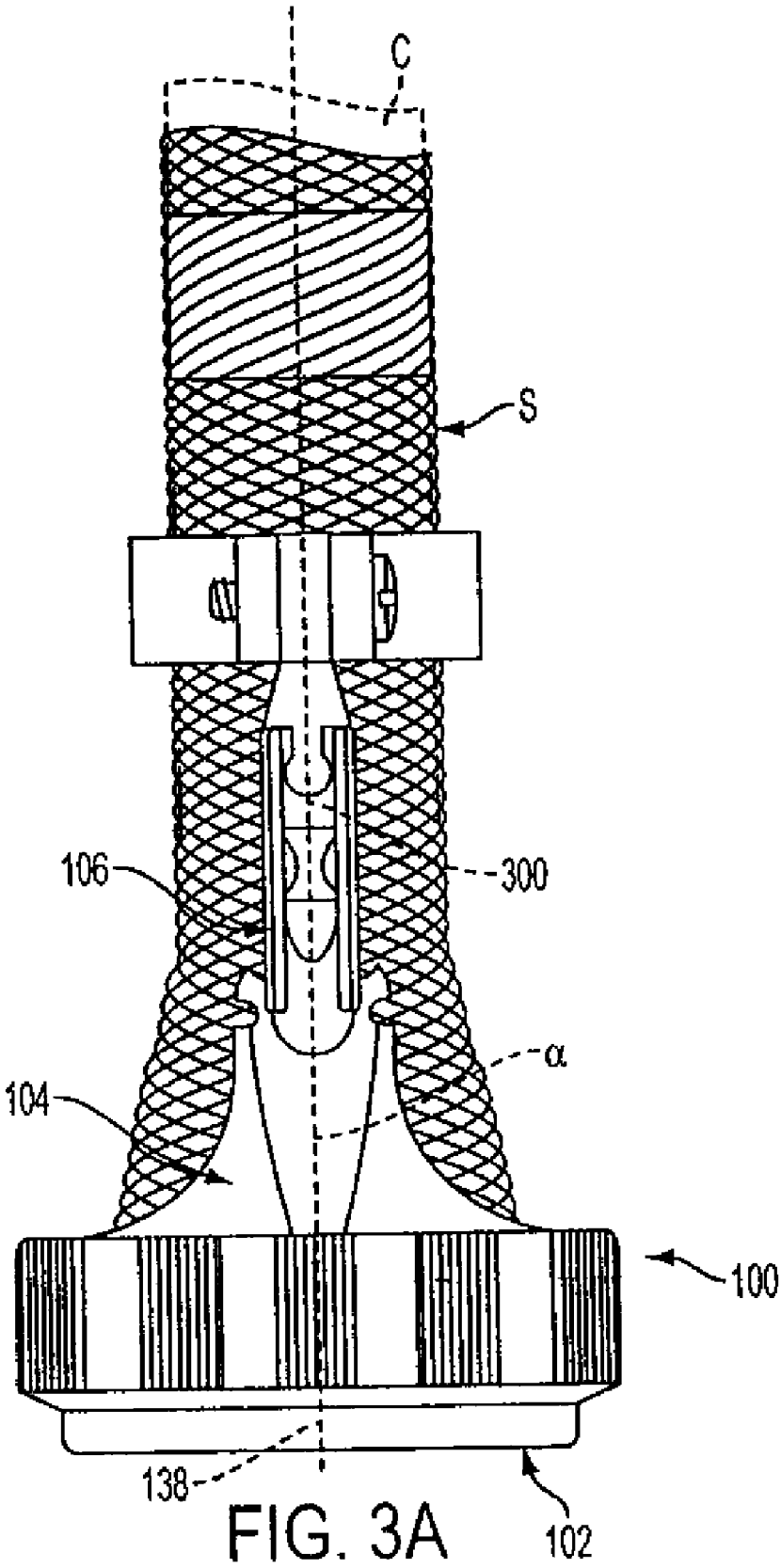
FIGS. 3A-3C are side elevation views of the backshell assembly illustrated in FIG. 2, showing the backshell assembly, in each of the three different configurations with respect to cable.
Figure 3B:
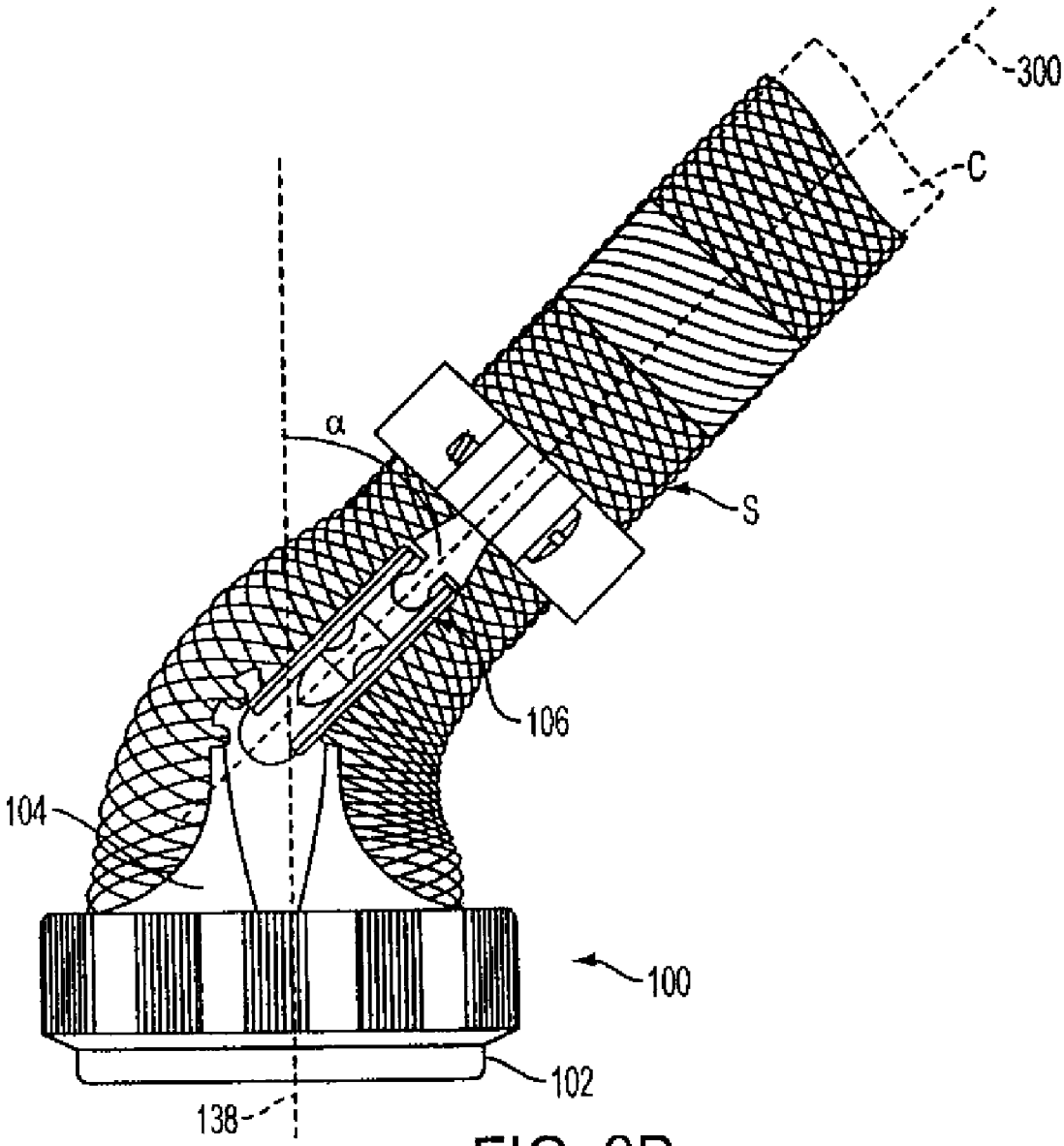
Figure 3C:
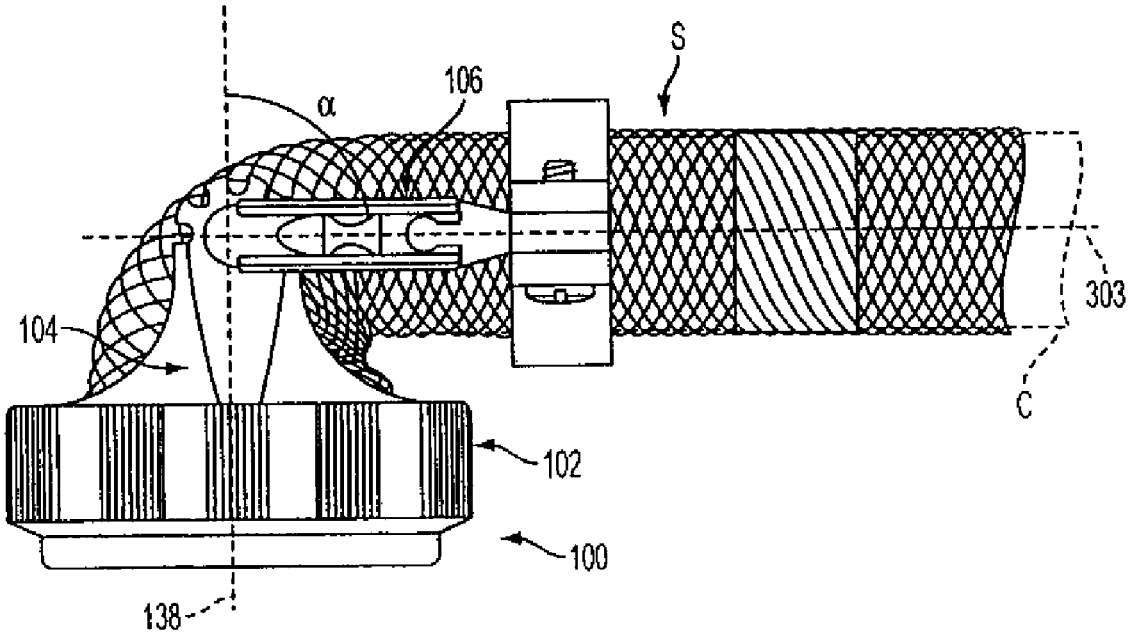

In general the strain relief backshell assembly 100 includes a coupling nut 102 that interfaces with the electrical connector; a backshell housing 104 that receives and terminates the shielding braid of cable C and mates with the coupling nut 102; and an adjustable strain relief structure 106 that clamps to the cable C, couples to the backshell housing 104, and allows adjustment of the position of the cable C with respect to the backshell housing 104. The adjustable strain relief structure 106 allows in field adjustment of the cable configuration with respect to the electrical connector without disassembling the housing 104 and the strain relief structure 106. The in field adjustment also eliminates the need for separate backshell assemblies corresponding to different configurations of the cable. FIGS. 3A, 3B, and 3C illustrate three exemplar configures of the cable C, i.e. 0°, 45° and 90° configurations.

Figure 1:
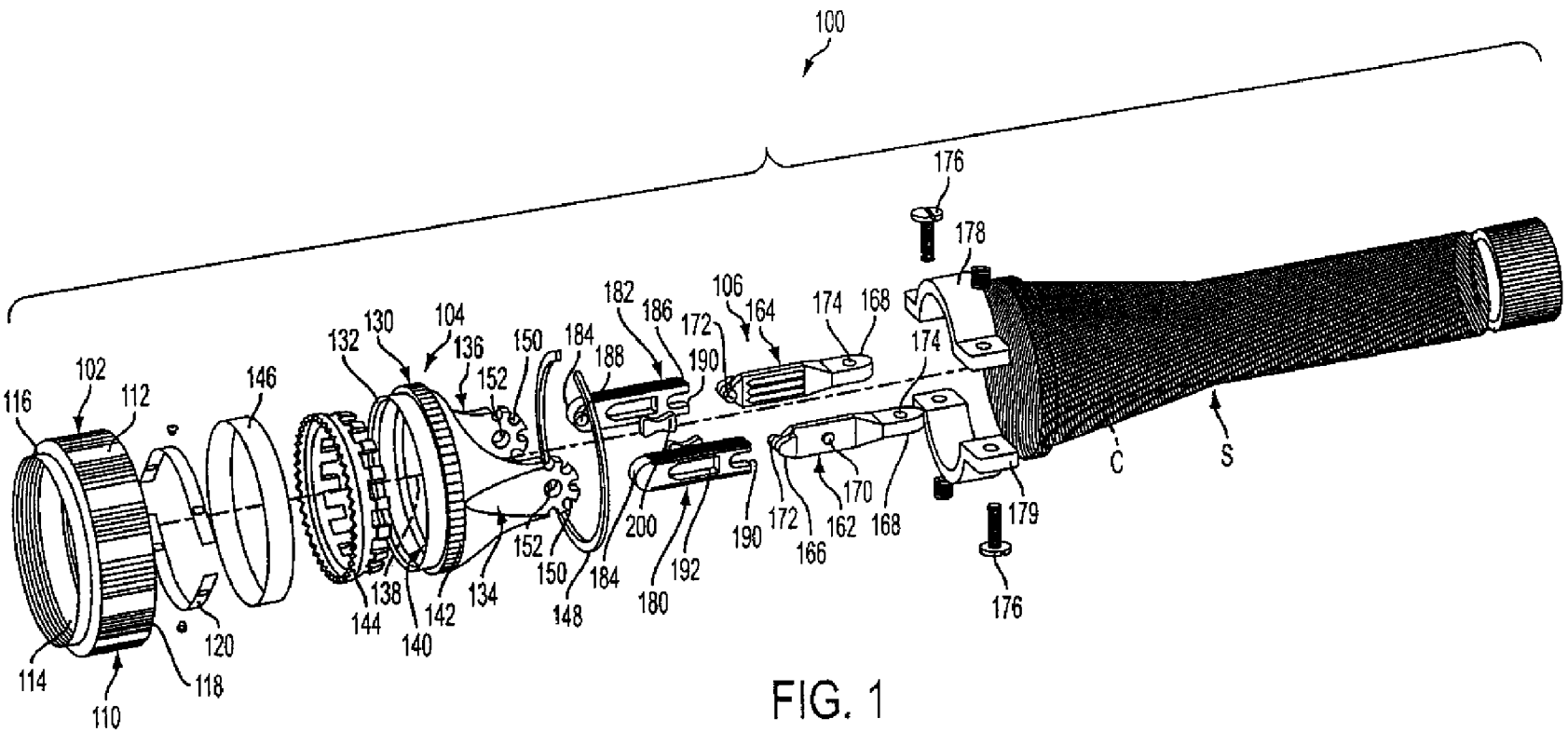
FIG. 1 is an exploded perspective view of a backshell assembly according to an exemplary embodiment of the invention.
Figure 2:
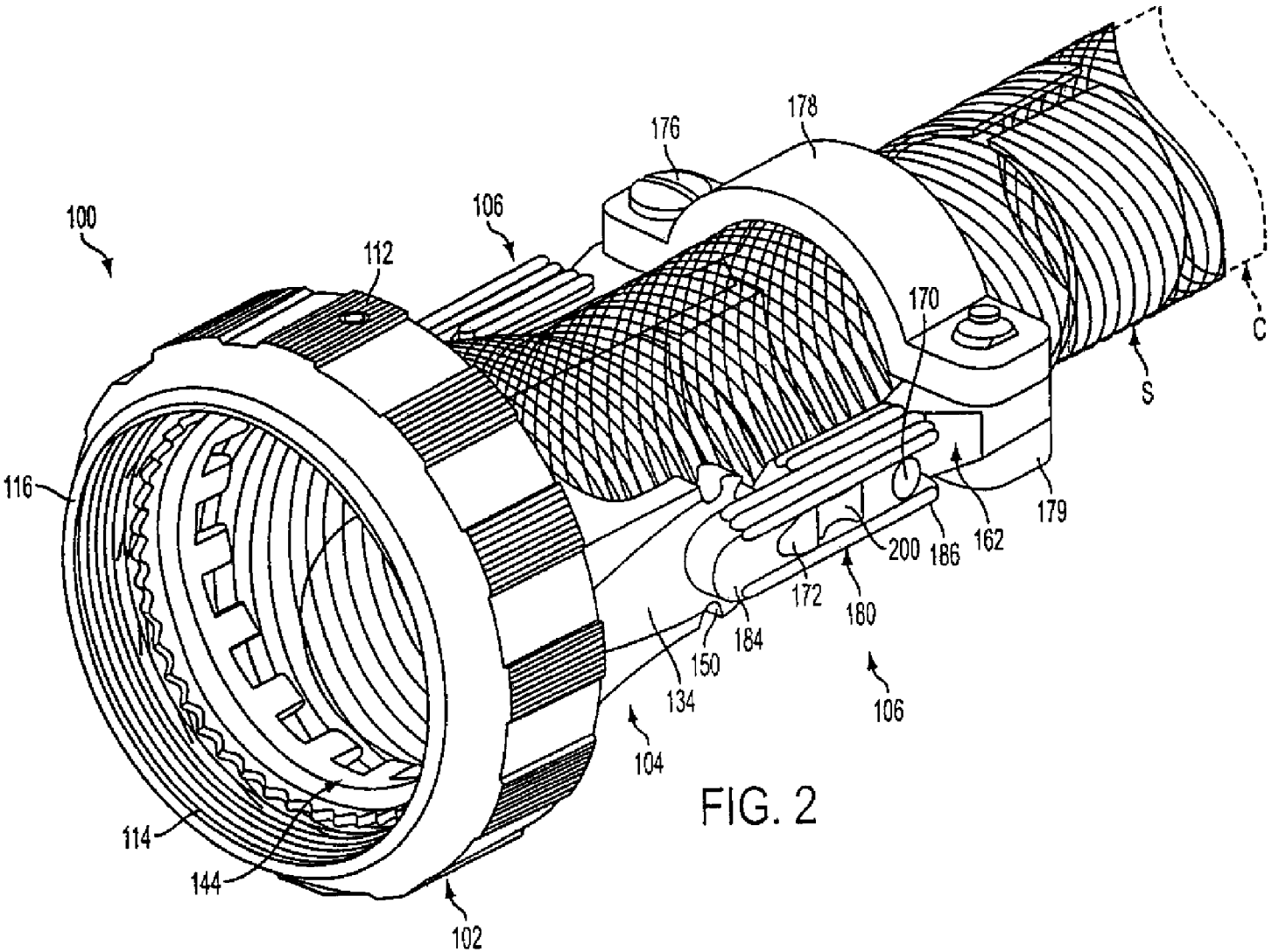
FIG. 2 is an enlarged perspective view of the backshell assembly illustrated in FIG. 1, showing the backshell assembly in an assembled configuration ready for terminating a cable.

As seen in FIGS. 1 and 2, the coupling nut 102 may include a ring body 110 with an outer gripping surface 112 and internal threads 114. An opening face 116 of the coupling nut 102 receives the electrical connector and threads thereon via its internal threads 114. The face 118 opposite the opening face 116 mates with the backshell housing 104. The coupling nut 102 may also accept anti-vibration springs 120 as is well known in the art.

The backshell housing 104 may include a main ring-shaped body 130 having a connector interface 132 at one end and adjustment extensions 134 and 136 at the other end. The main body 130 defines a central longitudinal axis 138 and an inner bore 140 that receives the cable C along the central longitudinal axis 138. A ring of gear teeth 142 may extend outwardly from the main body 130 which function to reduce vibration. The housing 104 may also accept an accessory locating ring 144 and a termination ring 146.

Figure 6:
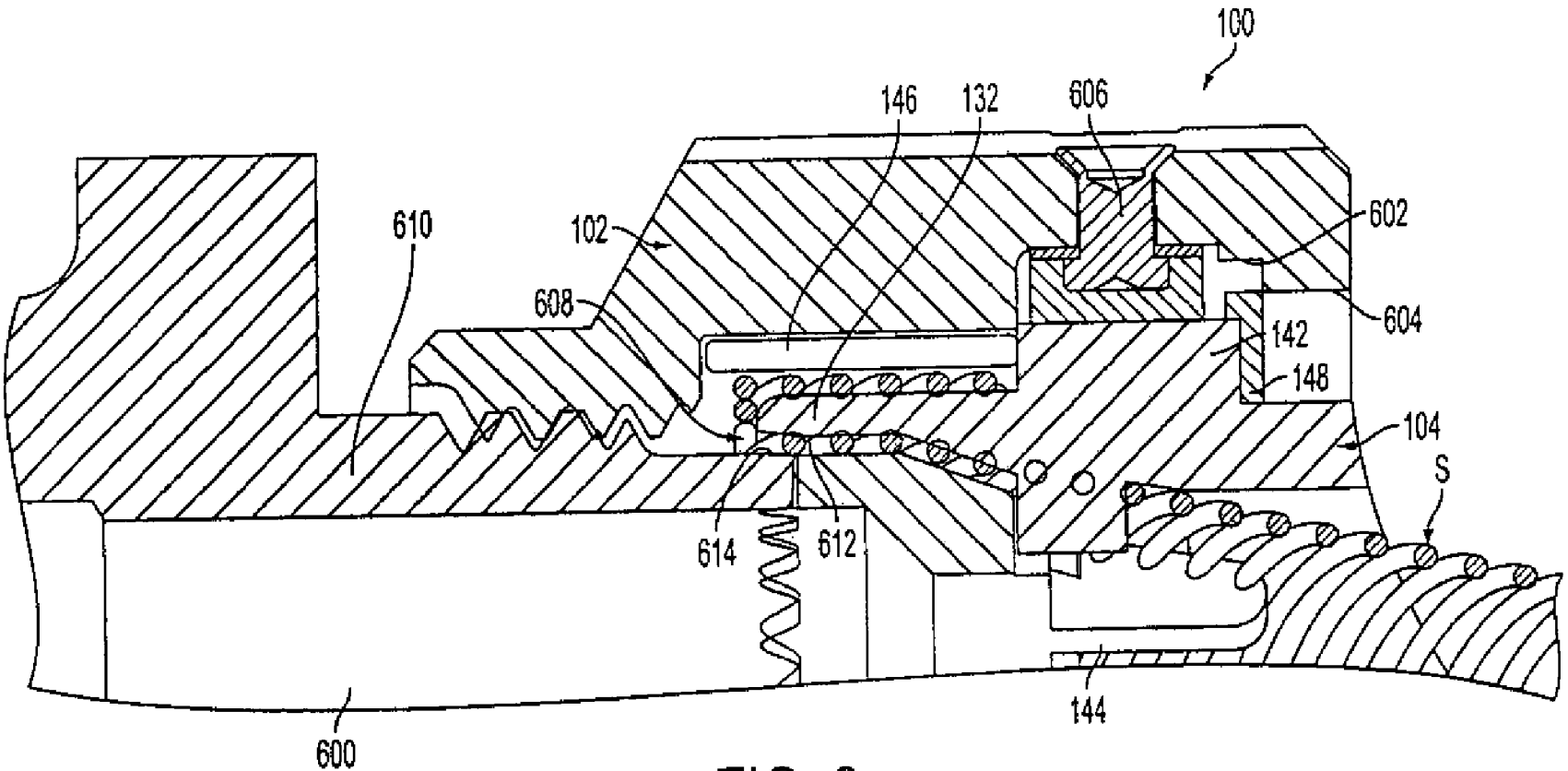
FIG. 6 is an enlarged partial side view in section of the backshell assembly connected to an electrical connector, showing the method for shielding braid termination whereas the shielding braid makes direct contact with the rear outside diameter of an electrical connector.

As seen in FIGS. 2 and 6, the connector interface 132 is received in the open end 116 of the coupling nut 102 for connection to the electrical connector 600. A retaining ring 148 positioned behind the ring of gear teeth 142 retains the housing 104 in the coupling nut 102.

Figure 4:
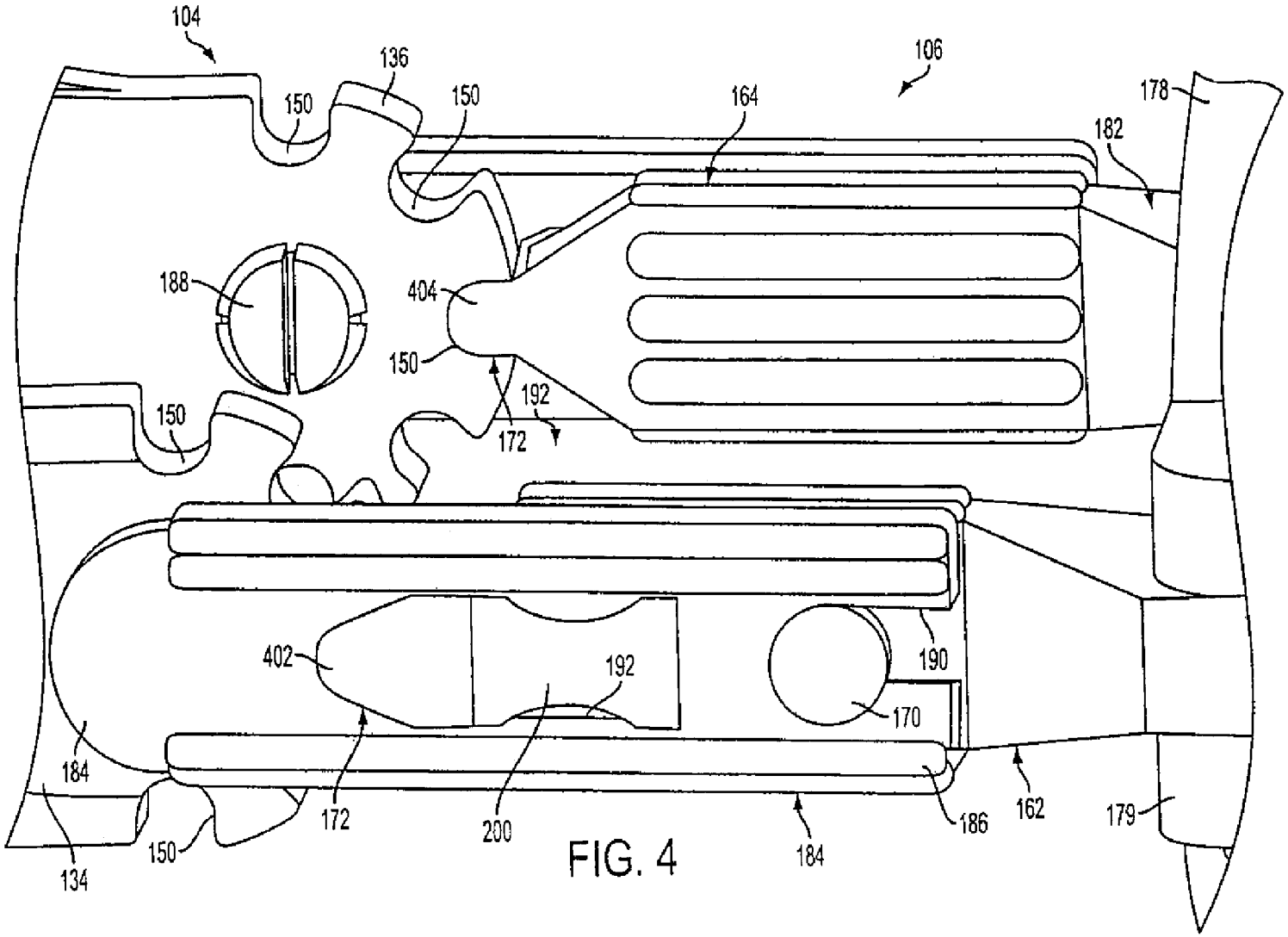
FIG. 4 is an enlarged partial side perspective view of the backshell assembly illustrated in FIG. 2, showing a strain relief structure of the backshell assembly engaged with a housing of the backshell assembly.

The adjustment extensions 134 and 136 of the housing 104 extend generally parallel to the central longitudinal axis 138 along the outside of the EMI braid shield S and are configured to couple with the strain relief structure 106. Each extension 134 and 136 is substantially flat with a distal end that includes a plurality of radial notches 150 (FIGS. 1 and 4). Central to the radial notches 150 is a pivot hole 152 that allows rotation of the strain relief structure 106 and the cable C with respect to the housing 104.

As best seen in FIG. 1, the adjustable strain relief structure 106 may have an adjustment member 160 that preferably includes a pair of first strain relief arms 162 and 164. Although the pair of arms 162 and 164 is preferred, the adjustment member may include only a single strain relief arm, or it may include other structures, such as a ring body.

Each first strain relief arm 162 and 164 may include opposite first and second ends 166 and 168. Between the first and second ends 166 and 168 of each arm is a locating pin 170. Each first end 166 includes a position pin 172 extending therefrom toward the opposite arm and each second end 168 includes a fastening hole 174. The fastening holes 174 receive fasteners 176, such as screws, for coupling the first strain relief arms 162 and 164 to respective cable clamps 178 and 179. The cable clamps 178 and 179 may be clamped to the cable C, as is well known in the art.

The adjustable strain relief structure 106 may also include a pair of second strain relief arms 180 and 182. Each second strain relief arm 180 and 182 includes opposite first and second ends 184 and 186. Each first end 184 includes a pivot pin extension 188 (FIGS. 4 and 5) extending towards the opposite arm that engages the respective pivot holes 152 of the backshell housing extensions 134 and 136. That allows the strain relief structure 106 to rotate with respect to the backshell housing 104. Each second end of the strain relief arms 180 and 182 includes a cut-out 190 sized to receive the location pin 170 of a respective first strain relief arm 162 and 164. Between the first and second ends 184 and 186 of each second strain relief arm 180 and 182 is a slot 192 that receives a portion of the position pin 172 of a respective first arm 162 and 164. Each first strain relief arm 162 and 164 is moveable with respect to a respective second strain relief arm 180 and 182 by sliding the pins 172 within the slots 192. That allows adjustment of the strain relief structure 106 by moving the first strain relief arms 162 and 164 into and out of engagement with the backshell housing 104.

A biasing member 200 is supported in the slot 192 of each of the second strain relief arms 180 and 182. The biasing member 200 is preferably a rubber spring, but may be any known biasing mechanism, such as a compression spring.

Figure 5:
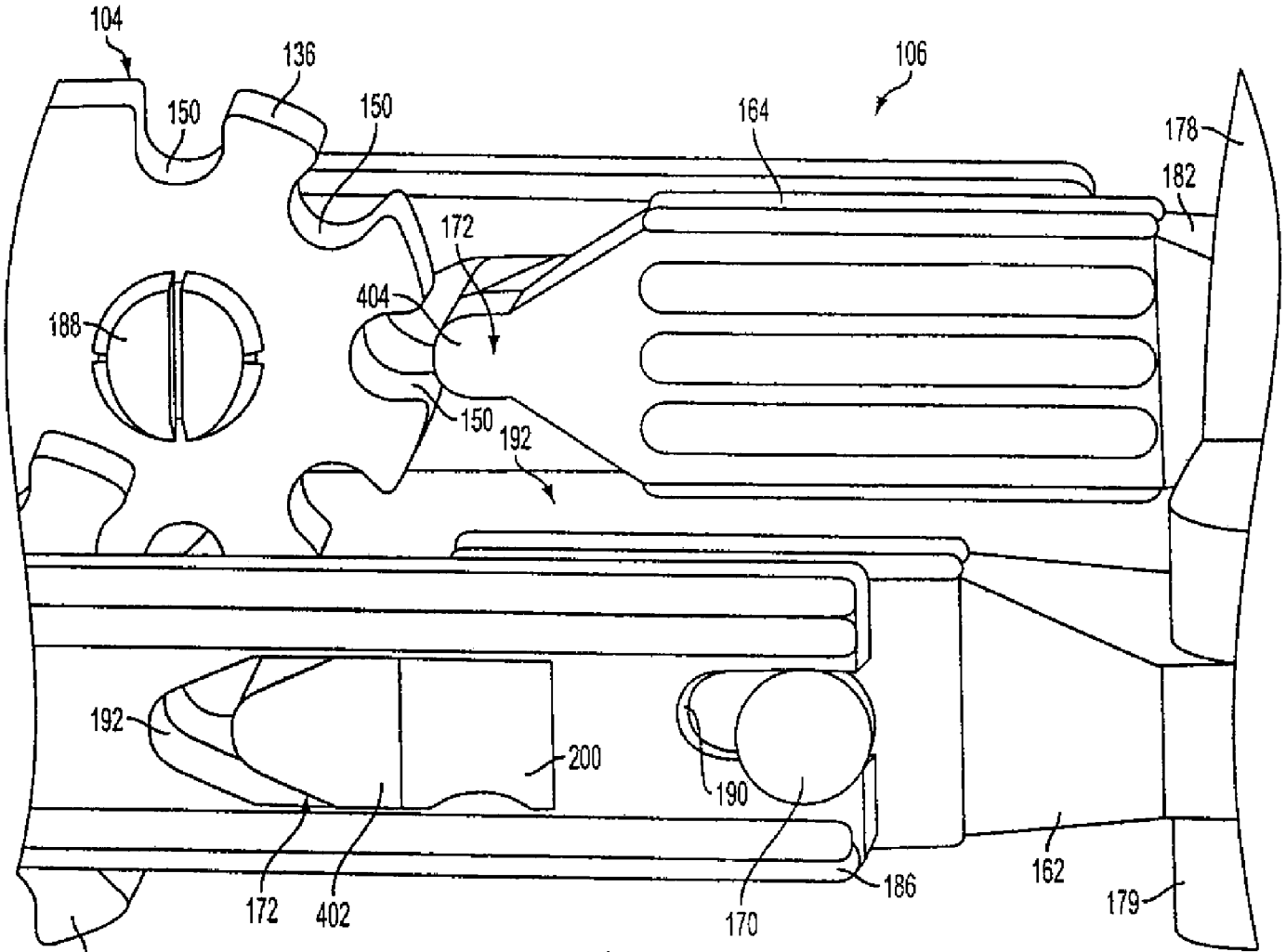
FIG. 5 is an enlarged partial side perspective view of the backshell assembly illustrated in FIG. 2, showing the strain relief structure disengaged from the housing.

Referring to FIGS. 4 and 5, the first strain relief arms 162 and 164 being engaged with and disengaged with the extensions 134 and 136 of the backshell housing 104, respectively, is shown. The first strain relief arms 162 and 164 are slidably coupled to the second strain relief arms 180 and 182 such that the first strain relief arms 162 and 164 are located inside of a respective second strain relief arm 180 and 182. In FIG. 4, the biasing members 200 bias the first strain relief arms 162 and 164 into engagement with the extensions 134 and 136 of the backshell housing 104. Specifically, a portion 402 of each location pin 172 of the first strain relief arms 162 and 164 is received in respective slots 192 of the second strain relief arms 180 and 182 with the biasing member 200 located between the portion 402 and the end of the slot 192. The other portion 404 of the location pin 172 is received in one of the notches 150 of the backshell housing extensions 134 and 136. Each notch 150 represents a different position of the strain relief structure 106 and the cable C with respect to the backshell housing 104.

Disengaging the pins 172 of the first strain relief arms 162 and 164 from the notches 150 of the housing extensions 134 and 136 allows adjustment of the cable C to different positions, as illustrated in FIGS. 3A-3C. As seen in FIG. 5, the pins 172 are disengaged from the notches 150 by sliding the first strain relief arms 162 and 164 toward the cable clamps 178 and 179 and compressing the biasing members 200. Locating pins 170 of the first strain relief arms 162 and 164 also slide with respect to the cut-outs 190 of the second strain relief arms 180 and 182. The separation of the position pins 172 from the notches 150, allows the second strain relief arms 180 and 182 to pivot about pivot pins 172 with respect to the housing extensions 134 and 136 to a desired position for the cable C. Then by releasing the first strain relief arms 162 and 164, the biasing members 200 force the position pins 172 into the desired notches 150.

FIGS. 3A-3C illustrate exemplary positions in which the cable C may be configured with respect to the backshell housing 104 using the adjustable strain relief structure. FIG. 3A shows the cable C in a 0° configuration. That is the angle $\alpha$ between the central longitudinal axis 138 of the backshell housing and an axis 300 of the strain relief structure 106 and the cable C is 0°. FIG. 3B shows the cable C in a 45° configuration with the angle $\alpha$ between the central longitudinal axis 138 and the axis 300 being 45°. FIG. 3C shows the cable C in a 90° configuration with the angle $\alpha$ between the central longitudinal axis 138 and the axis 300 being 90°. The cable C may be adjusted to any configuration based on position notches 150 of the housing extensions 134 and 136. Any number of position notches 150 may be used, although at least 2 position notches 150 is preferred.

Referring to FIG. 6, a cross-sectional view of the coupling nut 102 coupled with an electrical connector 600 and the backshell housing 104. The ring of gear teeth 142 are received in a recessed portion 602 in the inner surface 604 of the coupling nut 102. The retaining ring 148 is located between the gear teeth 142 to retain the housing 104 in the coupling nut 102. The accessory locating ring 144 is located inside of the backshell housing 104 at its connector interface 132. For clarity, only the shielding braid S (and not cable C) is shown in FIG. 6. A terminal end 608 of the shielding braid S wraps around the connector interface 132 of the backshell housing 104. That allows direct contact with the connector shell 610 of the electrical connector 600 and the braid S. Specifically, the terminal end 608 of the shielding braid S is sandwiched between an inner surface 612 of the housing connector interface 132 and an outer surface 614 of the connector shell 610 when the electrical connector 600 is mated with the backshell assembly 100. No additional components are needed between the braid's terminal end 608 and the connector shell to providing EMI protection. That ensures better EMI protection due to the elimination of intermediate electrical interfaces.

As seen in FIG. 6, steel rivets 606 are located in the coupling nut 102 and the termination ring 146 is disposed around the housing interface 132 and the shielding braid.

Figure 11:
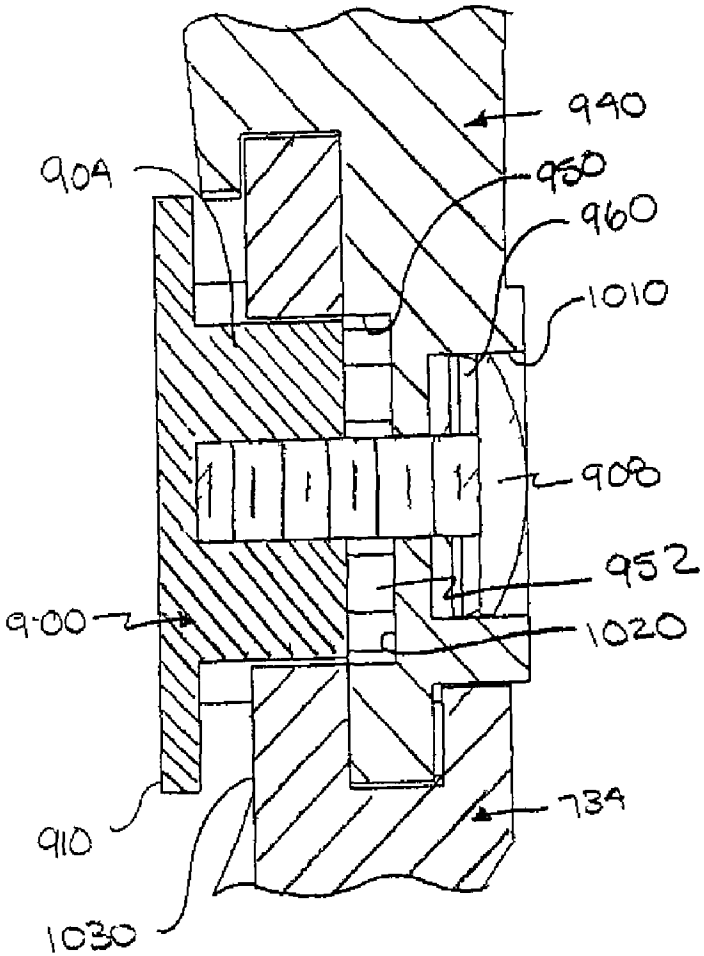
FIG. 11 is a partial cross-sectional view of the backshell assembly similar to FIG. 10, showing the fastener and the biasing member in a depressed position.
Figures 12A, 12B, 12C:
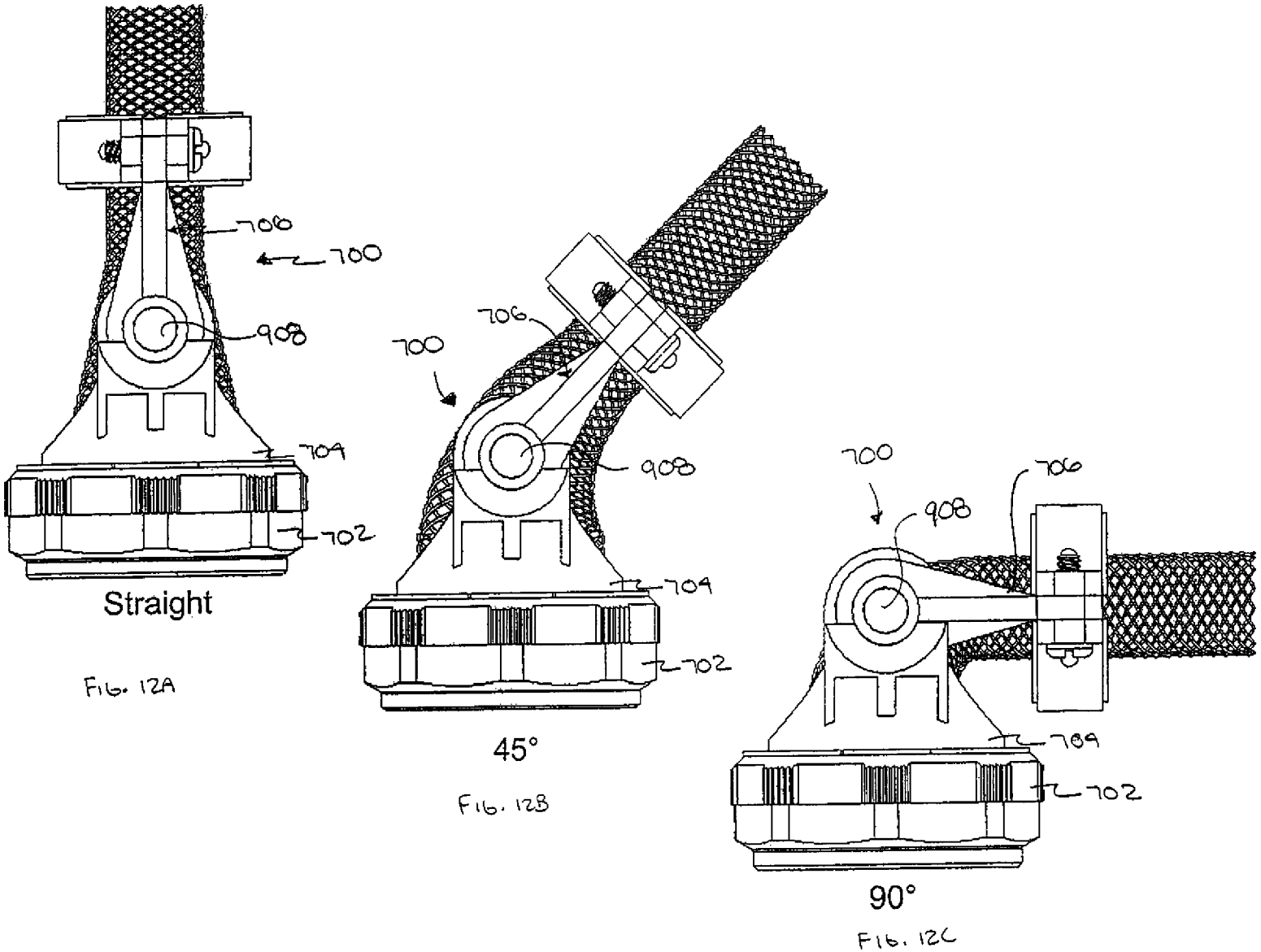
FIGS. 12A-12C are side elevational views of the backshell assembly illustrated in FIG. 7, showing the backshell assembly, in different exemplary configurations with respect to cable.

FIGS. 7-11, and 12A-12C illustrate another exemplary embodiment of a strain relief backshell assembly 700 similar to backshell assembly 100. Like the backshell assembly 100 of the first embodiment, the backshell assembly 700 includes a coupling nut 702 that interfaces with the electrical connector; a backshell housing 704 that mates with the coupling nut 702 and receives and terminates a cable and; and an adjustable strain relief structure 706 that couples to the backshell housing 704 to allow adjustment of the position of the cable with respect to the backshell housing 104. The adjustable strain relief structure 106 allows adjustment in a variety of configurations, such as illustrated in FIGS. 12A-12C. Although FIGS. 12A-12C illustrate 0°, 45° and 90° configurations, the design of the backshell assembly 700 allows adjustments in configurations as small as 10°.

Figure 7:
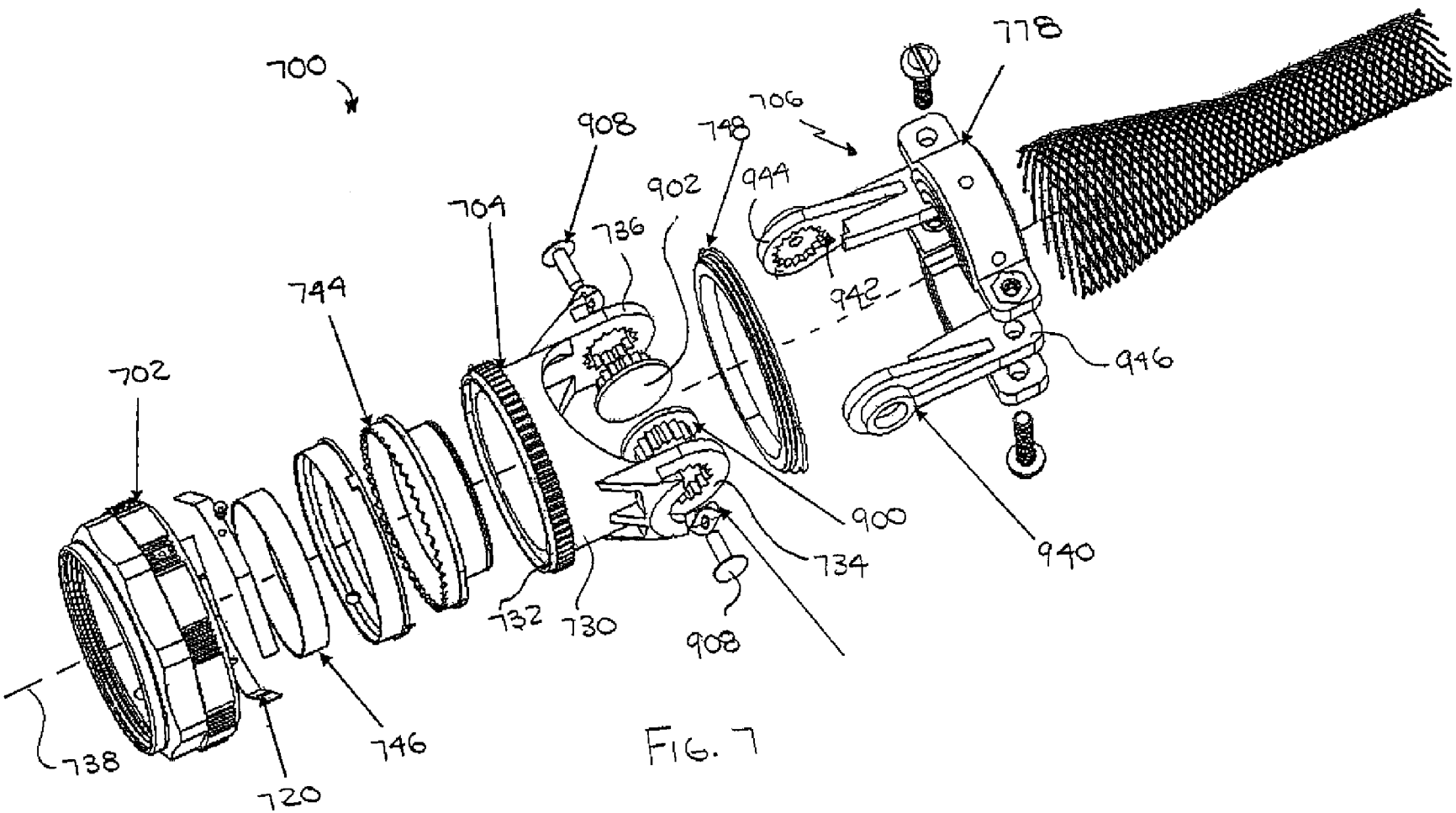
FIG. 7 is an exploded perspective view of a backshell assembly according to another exemplary embodiment of the invention.

The coupling nut 702, seen in FIG. 7, is the substantially the same as the coupling nut 102, receives an electrical connector in the same manner as coupling nut 102, and couples to the backshell housing 704 in the same manner that coupling nut 102 engages the backshell housing 104 of the first embodiment via a coupling nut retainer 748.

The backshell housing 704 is similar to the backshell housing 104 in that it also includes a main ring-shaped body 730 and has a connector interface 732 at one end and adjustment extensions 734 and 736 at the other end. The inner bore receives the cable along the central longitudinal axis 738 defined by the main body 730. Like the backshell assembly 100 of the first embodiment, the backshell assembly 700 may also include anti-vibration springs 720, an accessory locating ring 744 and a termination ring 746.

Figure 9:
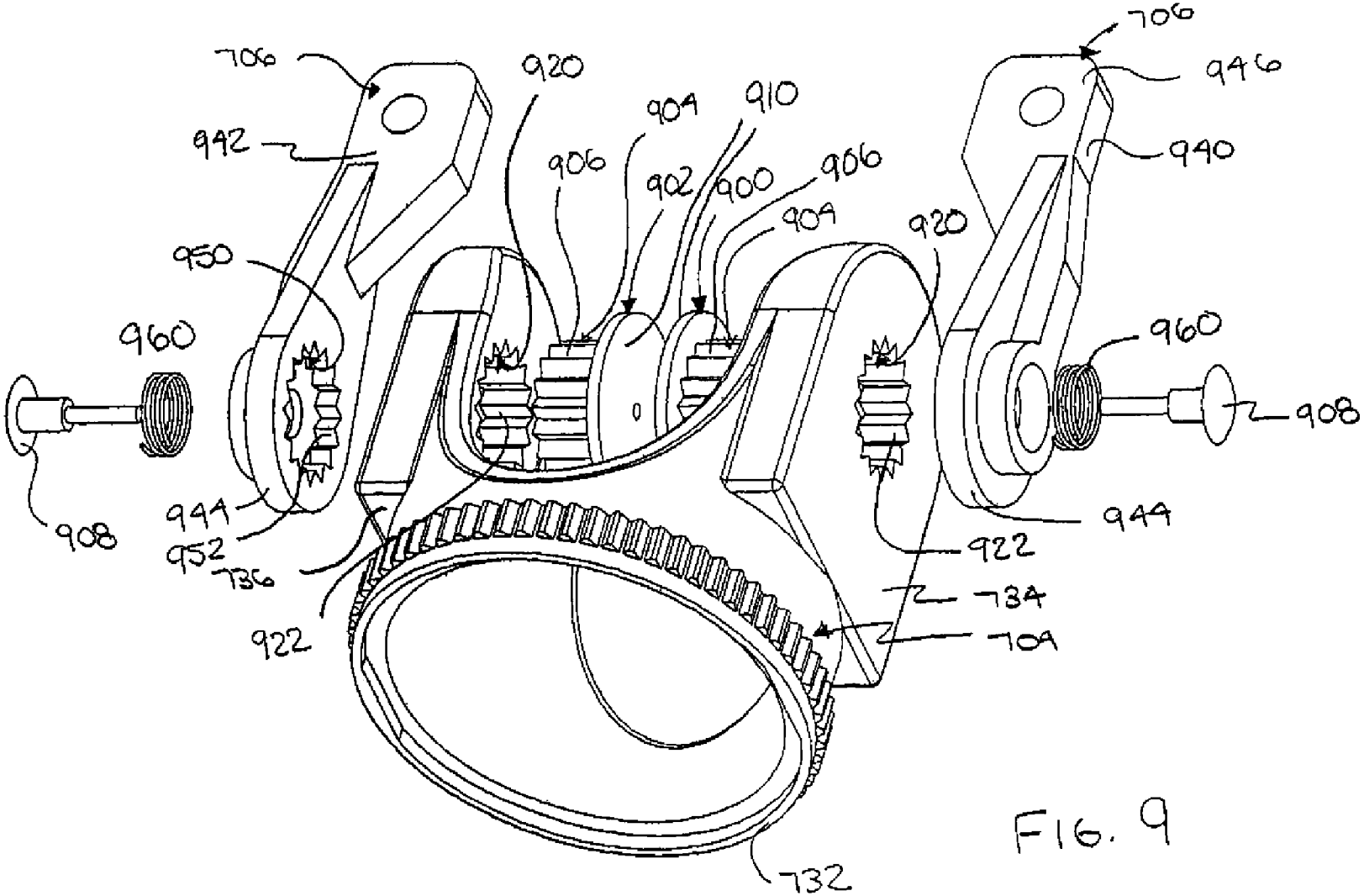
FIG. 9 is an exploded enlarged perspective view of the backshell assembly illustrated in FIG. 8.

Unlike the first embodiment, the backshell assembly 700 includes moveable locking members 900 and 902 that allow the strain relief structure 706 to pivot between different cable positions, as seen for example in FIGS. 12A-12C, and lock in selected positions without having to disassemble the backshell assembly. Each locking member 900 and 902 includes a main spline 904 which includes a plurality of gear teeth 906 extending therefrom, as best seen in FIG. 9. Each locking member 900 and 902 also includes an actuator 908 coupled to the main spline 904. The actuator is preferably a fastener, such as a screw threaded into the spline; however the actuator can be any member that extends from the spline 904 and can be formed integrally with the spline 904. The main spline 904 of each locking member 900 and 902 may also include a disc shaped backing plate 910.

Figure 8:
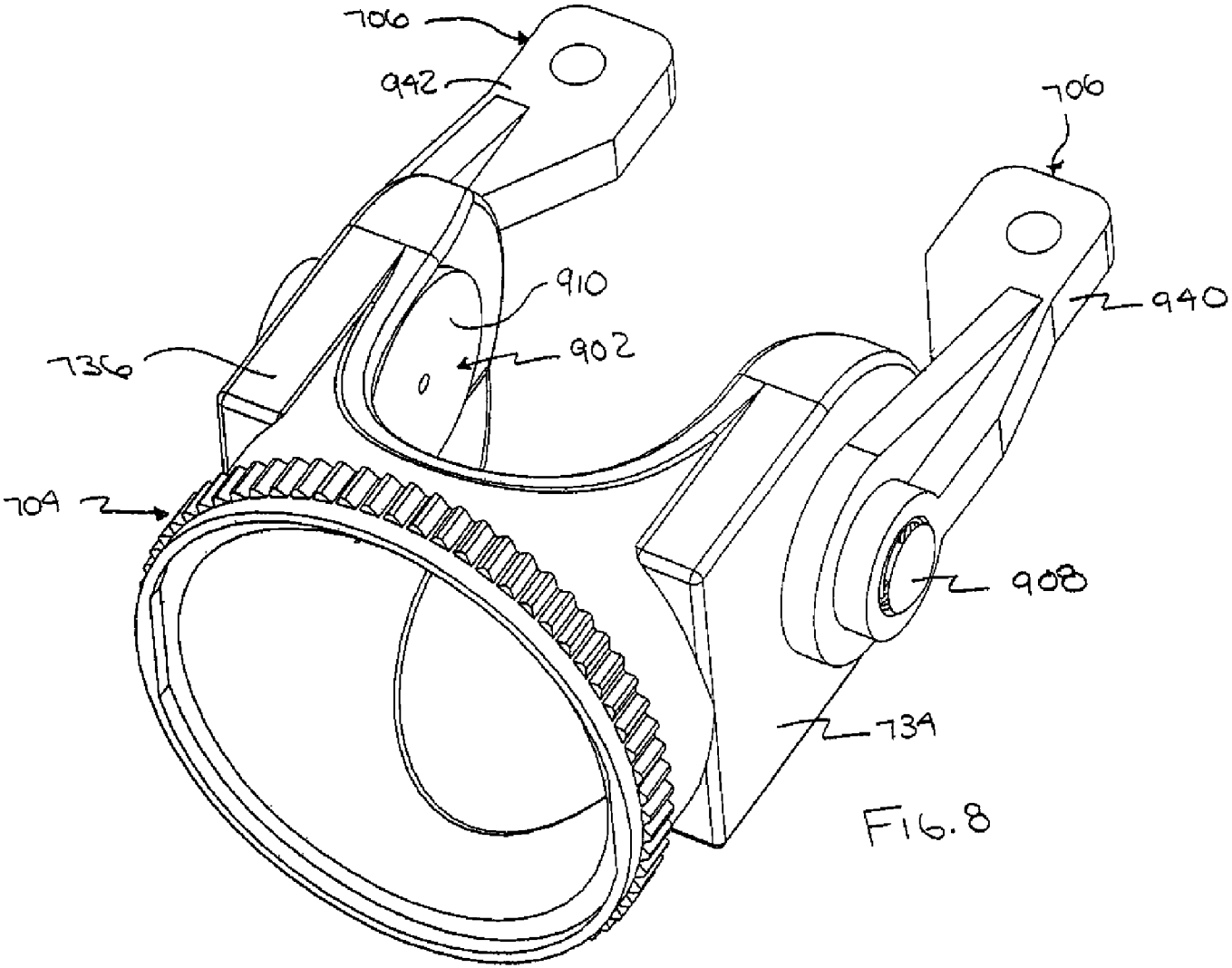
FIG. 8 is an enlarged perspective view of the backshell assembly illustrated in FIG. 7, showing the backshell assembly in an assembled configuration ready for terminating a cable.

As seen in FIGS. 8 and 9, the adjustment extensions 734 and 736 of the backshell housing 704 each includes an opening 920 that corresponds to and receives one of the locking members 900 and 902. The openings 920 may also include gear teeth 922 corresponding to the gear teeth 906 of the locking members 900 and 902. Although it is preferable that the openings 902 include the gear teeth 922 it is not necessary.

As seen in FIGS. 1 and 9, the adjustable strain relief structure 706 differs from the strain relief structure 106 of the first embodiment. The adjustable strain relief structure 706 includes first and second adjustment members 940 and 942 each having a first end 944 that couples to the housing 704 and one of the locking members 900 and 902 and an opposite second 946 which couples to a cable clamp 778 (FIG. 7). Each adjustment member 940 and 942 may be a support arm that includes an opening 950 at its first end 944. Each opening 950 may include gear teeth 952 that correspond to the gear teeth 906 of the locking members 900 and 902. The openings 950 of the adjustment members 940 and 942 correspond to and align with the openings 920 of the housing adjustment extensions 734 and 736, thereby allowing the locking members 900 and 920 to be received in both openings 920 and 950, as seen in FIG. 8.

Figure 10:
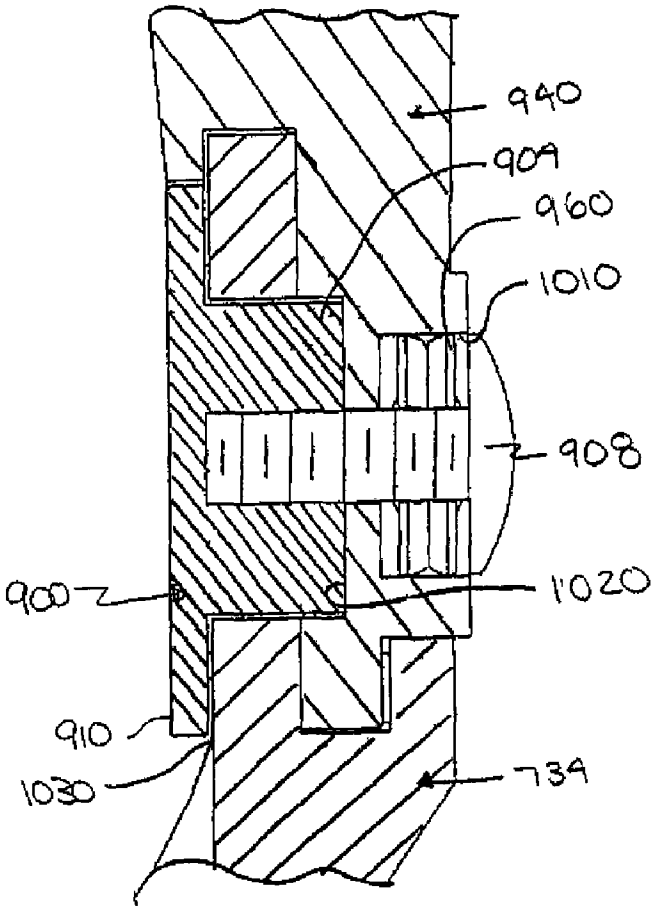
FIG. 10 is a partial cross-sectional view of the backshell assembly illustrated in FIG. 8, showing a fastener and a biasing member in a released position.

To allow for adjustment of the assembly between cable positions without having to disable the assembly, a biasing member 960 is received in the recesses 1010 (FIG. 10) of the adjustment members 940 and 942 and is supported by the locking members 900 and 902. The biasing member is preferably a compression spring. As seen in FIGS. 10 and 11, by pressing on the actuator 908 of the locking members 900 and 902 against the bias of the biasing member 960 and releasing the actuator 908, the locking member moves into and out of engagement with the housing 704 and adjustable strain relief structure 706. Because both locking members 900 and 902, both housing extensions 734 and 736 and both adjustment members 940 and 942 have substantially the same structure and operate in substantially the same manner, only locking member 900, housing extension 734, and adjustment member are described with respect to FIGS. 10 and 11.

FIG. 10 illustrates the locking member 900 in an engaged or locked position with the housing's adjustment extension 734. As seen in FIG. 10, the biasing member 960 extends around the locking member's actuator 908 and is received in a recess 1010 of the adjustment member 940. At least a portion of the locking member 900 is received in the opening 950 of the adjustment member 940 so that the gear teeth 906 of the locking member 900 are received in the gear teeth 952 of the opening 950. The biasing member 960 biases the actuator 908 of the locking member 900 outwardly until the spline 904 abuts a wall 1020 of the adjustment member to lock the adjustment member 940 in a selected cable position. The backing plate 910 of the locking member 900 may also abut against the inner surface 1030 of the housing extension 734.

To release the locking member 900 and allow adjustment to a different cable position, the actuator 908 of the locking member 900 is depressed, as seen in FIG. 11. FIG. 11 illustrates the locking member 900 in an unlocked or disengaged position with respect to the housing adjustment extension 734 and the adjustment member 940. When the actuator 908 is depressed, the locking member 900, and particularly its spline 904, slides out of engagement with the opening 950 of the adjustment member 940 allowing the adjustment member to pivot with respect to the housing adjustment extension 734 to a selected position, such as the exemplary configurations shown in FIGS. 12A-12C. Once a cable position is selected, he may actuator 908 be released and the biasing member 960 will force the locking member spline 904 back into engagement with the opening 950 of the adjustment member 940, as seen in FIG. 10, to lock the adjustment member 940 in place.

As seen in FIGS. 12A-12C, by releasing the locking member 900 as described above, the adjustment members 940 and 942 and the cable can be pivoted with respect to the backshell housing 704 to any desired position. The gear teeth design of the backshell assembly 700 allows for small to large adjustment of the cable position, with the gear teeth defining the angles of adjustment. The locking members 900 and 902 insure that once a cable position is selected, the backshell assembly position is locking into that position.

While particular embodiments have been chosen to illustrate the invention, it will be understood by those skilled in the art that various changes and modifications can be made therein without departing from the scope of the invention as defined in the appended claims. For example, although two housing extensions, two locking members, and two adjustment members of the strain relief structure are illustrated and described, only one housing extension, one locking member and one adjustment member are needed.

What is claimed is:

1. A backshell assembly, comprising of:

a housing configured to terminate a cable, said housing having a main body defining a central longitudinal axis, a connector interface for mating with an electrical connector, and at least one adjustment extension extending from said main body opposite said connector interface and substantially parallel to said central longitudinal axis;

an adjustable strain relief structure coupleable to the cable and said housing, said adjustable strain relief structure including at least one adjustment member cooperating with said adjustment extension of said housing such that said adjustment member is pivotable between different cable positions with respect to said central longitudinal axis of said housing;

a movable locking member coupleable with said adjustment extension of said housing and said adjustment member of said adjustable strain relief structure to releasably lock said adjustment member in a selected cable position with respect to said housing; and a biasing member supported by said locking member, said biasing member biasing said locking member into engagement with said adjustment extension of said housing and said adjustment member, wherein said biasing member allows adjustment of said adjustment member between said different cable positions with respect to said adjustment extension of said housing without disassembly of said housing and said adjustable strain relief structure.

2. A backshell assembly according to claim 1, wherein said biasing member is a spring.

3. A backshell assembly according to claim 1, wherein said adjustment member defining an axis, and said different cable positions of said adjustment member with respect to said central longitudinal axis of said housing being defined by an angle between said axis of said adjustment member and said central longitudinal axis of said housing.

4. A backshell assembly according to claim 1, wherein said adjustment member is an arm having an opening at a distal end thereof that receives said biasing member.

5. A backshell assembly according to claim 1, further comprising:

at least one cable clamp coupled to an end of said adjustment member for clamping the cable.

6. A backshell assembly according to claim 1, wherein said adjustable strain relief structure includes a second adjustment member pivotable with respect to second adjustment extension of said housing; and a second movable locking member engages said second adjustment member and said second adjustment extension.

7. A backshell assembly according to claim 1, wherein said locking member engages corresponding openings in said adjustment extension and said adjustment member.

8. A backshell assembly according to claim 7, wherein said locking member defining an axis substantially perpendicular to said central longitudinal axis of said housing such that said locking member is slidable into engagement with said corresponding openings in said adjustment extension and said adjustment member.

9. A backshell assembly according to claim 7, wherein each of said corresponding openings in said adjustment extension and said adjustment member includes gear teeth; said gear teeth of said openings of said adjustment extension and said adjustment member being adapted to engage gear teeth of said locking member.

10. A backshell assembly according to claim 9, wherein said adjustment member defining an axis, and said different cable positions of said adjustment member with respect to said central longitudinal axis of said housing being defined by an angle between said axis of said adjustment member and said central longitudinal axis of said housing; and said angles of said different cable positions corresponding to said gear teeth of said adjustment extension and said locking member.

11. A backshell assembly according to claim 1, wherein said locking member includes an actuator for moving said locking member into and out of engagement with said adjustment extension and said adjustment member.

12. A backshell assembly according to claim 11, wherein said actuator supports said biasing member and extends through corresponding openings of said adjustment extension and said adjustment member.

13. A backshell assembly according to claim 12, wherein said actuator is a fastener coupled to a spline of said locking member.

14. A backshell assembly, comprising of:

a housing configured to terminate a cable, said housing having a main body defining a central longitudinal axis, and a connector interface for mating with an electrical connector;

an adjustment member coupleable to the cable and said housing such that said adjustment member is pivotable between different cable positions with respect to said central longitudinal axis of said housing, said adjustment member including an opening having gear teeth;

a movable locking member coupleable with said housing and said adjustment member to releasably lock said adjustment member in a selected cable position with respect to said housing, said movable locking member including gear teeth corresponding to the gear teeth of said adjustment member; and a biasing member supported by said locking member, said biasing member biasing said locking member into engagement with said housing and said adjustment member when said gear teeth of said adjustment member and said gear teeth of said locking member engage, wherein said biasing member allows adjustment of said adjustment member between said different cable positions with respect to said housing without disassembly of said housing and said adjustment member.

15. A backshell assembly according to claim 14, wherein said housing includes an opening with gear teeth; and said locking member slidably engaging said opening of said housing and said opening of said adjustment member.

16. A backshell assembly according to claim 14, wherein said adjustment member defining an axis, and said different cable positions of said adjustment member with respect to said central longitudinal axis of said housing being defined by an angle between said axis of said adjustment member and said central longitudinal axis of said housing; and said angles of said different cable positions corresponding to said gear teeth of said adjustment extension and said locking member.

17. A backshell assembly according to claim 14, wherein said locking member includes an actuator for moving said locking member into and out of engagement with said housing and said adjustment member.

18. A method of adjusting a backshell assembly for a cable, the backshell assembly including a housing, a movable locking member and an adjustable strain relief structure, comprising the steps of:

terminating an end of the cable with the housing of the backshell assembly;

coupling the adjustable strain relief structure to the cable;

coupling the adjustable strain relief structure with the housing by releasably engaging the locking member with an adjustment of the adjustable strain relief structure and with an extension of the housing to configure the cable in at least a first position with respect to the housing allowing rotation of the adjustable strain relief structure and the cable with respect to the housing;

disengaging the locking member from the housing and the adjustable strain relief structure by slidably moving the locking member with respect to the housing and the adjustment member against the bias of a biasing member supported by the locking member; and releasably locking the adjustment member of the adjustable strain relief structure in a second position different from the first position by sliding the locking member into engagement with the housing and the adjustment member with the bias of the biasing member.

19. A method according to claim 18, further comprising the step of:

rotating the adjustment member with respect to the housing after disengaging the locking member from the housing and the adjustment member.

20. A method according to claim 19, further comprising the step of:

rotating the adjustment member with respect to the housing by at least 10°.

* * * * *